US005779438A

United States Patent [19]

Wilfert

[11] Patent Number: 5,779,438

[45] Date of Patent: Jul. 14, 1998

[54] ARRANGEMENT FOR AND METHOD OF COOLING A WALL SURROUNDED ON ONE SIDE BY HOT GAS

[75] Inventor: Günter Wilfert, Küssaberg-Ettikon, Germany

[73] Assignee: ABB Research Ltd., Zurich, Switzerland

[21] Appl. No.: 794,056

[22] Filed: Feb. 4, 1997

[30] Foreign Application Priority Data

Mar. 30, 1996 [DE] Germany ..... 196 12 840.4

[51] Int. Cl.[6] ..... F04D 29/38

[52] U.S. Cl. ..... 415/115; 416/96 A

[58] Field of Search ..... 415/115, 116; 416/96 A, 97 R

[56] References Cited

U.S. PATENT DOCUMENTS

| | | | |
|---|---|---|---|
| 3,628,885 | 12/1971 | James | 416/96 A |
| 5,533,864 | 7/1996 | Nomoto et al. | 416/115 |

FOREIGN PATENT DOCUMENTS

| | | | |
|---|---|---|---|
| 0258754A2 | 3/1988 | European Pat. Off. . | |
| 2555049C2 | 6/1976 | Germany . | |
| 104507 | 8/1980 | Japan | 416/96 A |
| 52504 | 5/1991 | Japan | 416/96 A |
| 565991 | 7/1977 | U.S.S.R. | 416/96 A |

OTHER PUBLICATIONS

"Experimentelle und numerische Untersuchungen der Mischungsvorgange zwischen Kuhlfilmen und Gitterstromung an einem hobhbelasteten Turbinengitter", Wilfert, 1994.

*Primary Examiner*—John T. Kwon

*Attorney, Agent, or Firm*—Burns, Doane, Swecker & Mathis, L.L.P.

[57] ABSTRACT

An arrangement and method for cooling a wall surrounded on one side by hot gas, for example, a guide blade of a turbine, where cooling air is directed into a space between the wall and a cooling insert wall, and allowed to flow through rows of holes in the wall to an outer surface of the wall. A rib is arranged upstream of the row of holes on the inner surface of the wall, and the cooling insert wall is shaped to bulge toward the wall at the hole location, so that a guiding surface parallel to an entry angle of the holes is provided. By causing the cooling air to flow in the entry angle of the holes before it reaches the holes, the cooling air forms stable inner-vortex pairs in the flow, and entry losses are reduced. Cooling air not flowing into a first row of holes is accelerated and guided past spacers and pins in the space, before being guided to downstream rows of holes.

10 Claims, 1 Drawing Sheet

ARRANGEMENT FOR AND METHOD OF COOLING A WALL SURROUNDED ON ONE SIDE BY HOT GAS

BACKGROUND OF THE INVENTION

1. Field of the Invention

The invention relates to an arrangement for and a method of cooling a wall surrounded on one side by hot gas, in particular the hollow-profile body of a gas-turbine blade.

2. Discussion of Background

Ever increasing turbine inlet temperatures are being used in modern gas-turbine plants in order to increase output and efficiency. In order to protect the turbine blades from the increased hot-gas temperatures, they must be cooled more intensively than hitherto. At a correspondingly high turbine inlet temperature, purely convective cooling is therefore no longer sufficient. A remedy is provided here by film cooling, in which the turbine blades are protected from the hot gas by cooling films. To this end, corresponding recesses in the form of bores or slots are made in the blades, through which recesses the cooling air is blown out.

EP-A2-258 754 has already disclosed such a combination of convective cooling and film cooling of a turbine blade. In this solution, at least one cooling insert is arranged in the blade hollow space. The cooling air discharging from openings in the cooling insert first of all strikes the inner surface of the blade shell, is then directed in the hollow space between cooling insert and blade shell in such a way as to convectively cool the latter, and finally discharges via bores in the blade shell onto its outer surface in such a way as to provide film cooling of the latter.

For an optimum cooling effect, the blown-out cooling air must be deflected as quickly as possible and flow along the profile surface in a protective manner. In order to also protect the zones lying between the bores, rapid lateral spreading of the cooling air is also necessary. The most varied vortices arise in the regions in which the hot gas is mixed with the cooling-air jets, which vortices are of crucial importance for the protective effect of a cooling configuration. For example, a so-called kidney vortex, i.e. a vortex pair consisting of a clockwise and a counterclockwise vortex, is generated by the bending of the cooling-air jets upon their discharge from the bores. However, this kidney vortex transports some of the hot gas between the bores directly onto the profile surface of the turbine blades and thus under the cooling-air jets, which proves to be a serious disadvantage.

In it is already known, by appropriate shaping (contouring) of the inner geometry of the turbine blade, to deflect the cooling air into the bore in such a way that a vortex pair arises there with a direction of rotation opposed to the kidney vortex (see G. Wilfert, dissertation publication on the topic "Experimentelle und numerische Untersuchungen der Mischungsvorgänge zwischen Kühlfilmen und Gitterstroömung an einem hochbelasteten Turbinengitter", page 54, pages 70–74 and FIG. 7.2, Munich 1994). On account of such an inner vortex, the kidney vortex dissipates very quickly and the hot gas is not drawn in laterally under the cooling-air jet but is directed by the blow-out jet in a cooled state to the profile surface. It is thus possible to advantageously increase the cooling effectiveness in the bore intermediate space and without increased feeding of cooling air.

However, a considerable disadvantage of this solution is the low intensity of the inner vortex, so that the latter breaks down relatively quickly and cannot be used to bring about a lasting improvement in the cooling effectiveness.

In order to improve the film cooling, so-called fan-shaped bores are known. In this solution, the blow-out impulse of the cooling-air jet is reduced by means of a diffuser formed in the bore. Quicker lateral spreading of the cooling-air jet and improved film cooling respectively are thus achieved. However, the making of such fan-shaped bores is very complicated and a wall provided with such bores is correspondingly expensive.

SUMMARY OF THE INVENTION

Accordingly, one object of the invention, in attempting to avoid all these disadvantages, is to provide a simple arrangement provided with an improved cooling effect and a corresponding method of cooling a wall surrounded on one side by hot gas.

In an arrangement according to the invention, upstream of each row of recesses, a radial rib is arranged on the inner surface of the wall. In addition, the cooling insert is shaped in the region of the recesses in the direction of the wall and in the process is formed at least approximately parallel to the entry angle of the recesses.

With this cooling configuration combining the convective cooling and the film cooling, the inflow of the cooling fluid into the recesses is improved, as a result of which the in let losses in this respect are also reduced. To this end, the cooling fluid is already deflected in the direction of the recesses before it reaches the latter, the deflection being substantially increased by means of the rib. In particular, however, the vortex pair forming in each case inside the recesses and oriented in opposition to the kidney vortex is strengthened so that it has increased vortex intensity This inner vortex located at the lower jet margin of the respective cooling-air jets is now retained even during the discharge from the recesses, whereas the kidney vortex formed at the upper jet margin between the main flow of the hot gas and the cooling-air jet is broken down. The hot gas is thereby no longer drawn laterally under the cooling-air jet but is directed by the latter in a cooled state to the surface of the wall. In this way, a decisive improvement in the film cooling can be achieved.

In addition, the convective cooling of the wall between the adjacent rows of recesses is also improved by the ribs. The shaping of the cooling insert in the region of the recesses in the direction of the wall generates both an increased velocity of the cooling fluid flowing not into the recesses but further downstream between wall and cooling insert and a flow directed toward the wall. Improved heat transfer from the wall to the cooling fluid is achieved on account of this additional impact cooling and the increased flow velocity.

It thus follows that not only is the film cooling considerably improved but so too is the entire cooling of the wall. Cooling air can thereby be saved and used advantageously at another point. The manufacturing costs of such a cooling arrangement are not appreciably higher than those of conventional cooling configurations. However, there is a considerable cost saving compared with fan-shaped bores.

A wall cooled in such a way may also be used advantageously as a combustion-chamber wall or even as a heat-accumulation segment of a gas turbine.

It is especially expedient when the ribs are arranged at a distance of up to about 3 times the diameter of the respective recesses from the entry center point of the latter and project by about half the diameter up to one diameter of the recesses into the cooling hollow space. The cooling insert closes the cooling hollow space in the region of the recesses up to a maximum of 30% of the normal distance between wall and cooling insert. With such a cooling configuration, the inner vortex can be adapted in an optimum manner to the actual operating conditions, so that a stable inner-vortex pair results. In addition, the flow losses of the cooling fluid entering the recess is reduced.

Furthermore, it is advantageous when in each case at least one spacer and/or at least one pin is arranged in the cooling hollow space downstream of the recesses and is connected to the inner surface of the wall. In this case, the spacers extend up to the cooling insert, whereas the pins already end in front of it. The spacers already disclosed by the prior art can be used very effectively in combination with the film cooling according to the invention. In this case, their arrangement exactly between two rows of adjacent recesses is especially advantageous. In this region, in which virtually no film cooling is achieved up to about 5 recess diameters downstream of the center point of the recess, the spacers act as additional heat sinks for the wall to be cooled, i.e. they provide for heat transfer from the wall to the cooling fluid. When pins are used, their additional surface and the turbulent intermixing of the cooling fluid thus generated likewise acts as a heat sink.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings of a gas-turbine guide blade, wherein.

Only the elements essential for understanding the invention are shown. The entire gas-turbine plant with the compressor and the gas turbine is not shown. The direction of flow of the working media is designated by arrows.

DESCRIPTION OF THE PREFERRED EMBODIMENTS

Figure 1:
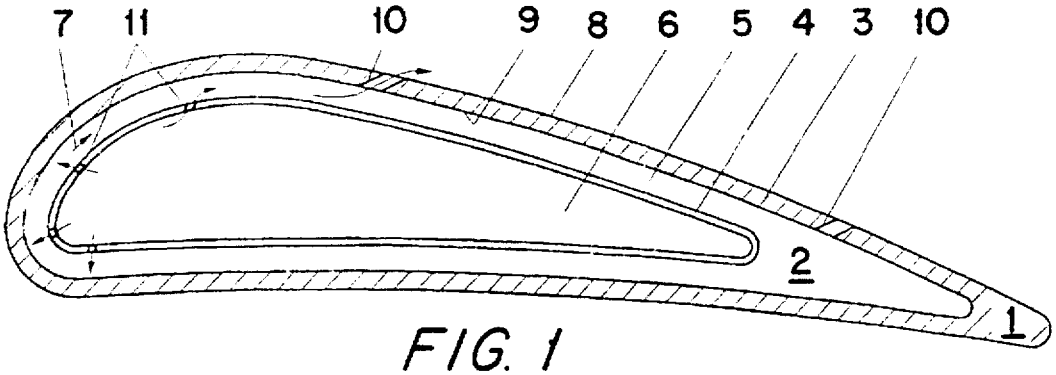
FIG. 1 (PRIOR ART)
FIG. 1 shows a profile cross-section of a gas-turbine guide blade of the prior art.

Referring now to the drawings, wherein like reference numerals designate identical or corresponding parts throughout the several views, the guide blade 1 of a gas turbine consists of a hollow-profile body 2 which has a wall 3 designed as an outer shell, a cooling insert 4 arranged at a distance therefrom, and a cooling hollow space 5 formed between the two. Formed in the interior of the cooling insert 4 is a blade hollow space 6 which is connected in a conventional manner to the compressor (not shown) of the gas-turbine plant and to which cooling air serving as cooling fluid 7 is admitted from the compressor. The outer shell 3 has an outer and an inner surface 8, 9, between which a plurality of rows of recesses 10 designed as cooling bores are arranged. The blade hollow space 6 is connected to the cooling hollow space 5 via a plurality of openings 11 arranged in the cooling insert 4 (FIG. 1). The guide blade 1 may of course also have only a single row of cooling bores 10.

Figure 2:
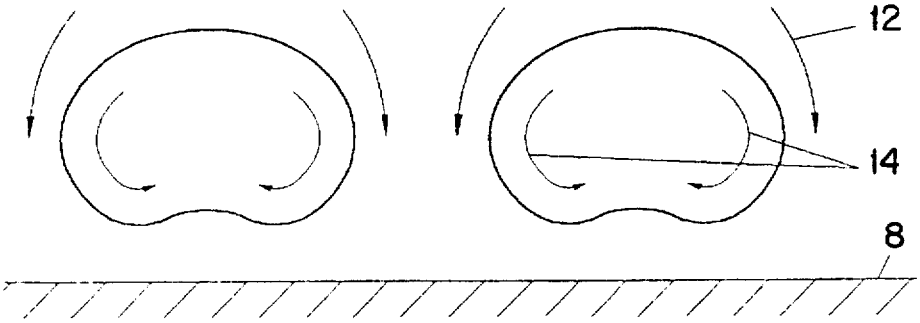
FIG. 2 shows a schematic representation of the kidney vortex formed on the outer surface of the outer shell, as viewed in the main flow direction.

During the operation of the gas-turbine plant, hot gas 12 flows out of the combustion chamber (not shown) over the guide blades 1 and the moving blades (likewise not shown) of the gas turbine. Therefore these blades must be constantly cooled. The guide blades 1 are cooled by means of cooling air 7 fed from the compressor, this cooling air 7 penetrating into the cooling hollow space 5 via the openings 11 in the cooling insert 4 and first of all convectively cooling the inner surface 9 of the outer shell 3. The cooling air 7 is then blown out through the cooling bores 10 in a multiplicity of cooling-air jets on the outer surface 8 of the outer shell 3. The bending of these cooling-air jets during their discharge into the main flow of the hot gas 12 is effected at a discharge angle 13 of about 30°. In the process, secondary flows are generated in the mixing region, which secondary flows form a vortex pair 14 having a clockwise and a counterclockwise vortex. This so-called kidney vortex 14 transports the hot gas 12 directly onto the outer surface 8 of the guide blade 1 (FIG. 2). However, direct contact of the guide blade 1 with the hot gas 12 must be avoided in order to prevent damage to it.

Figure 3:
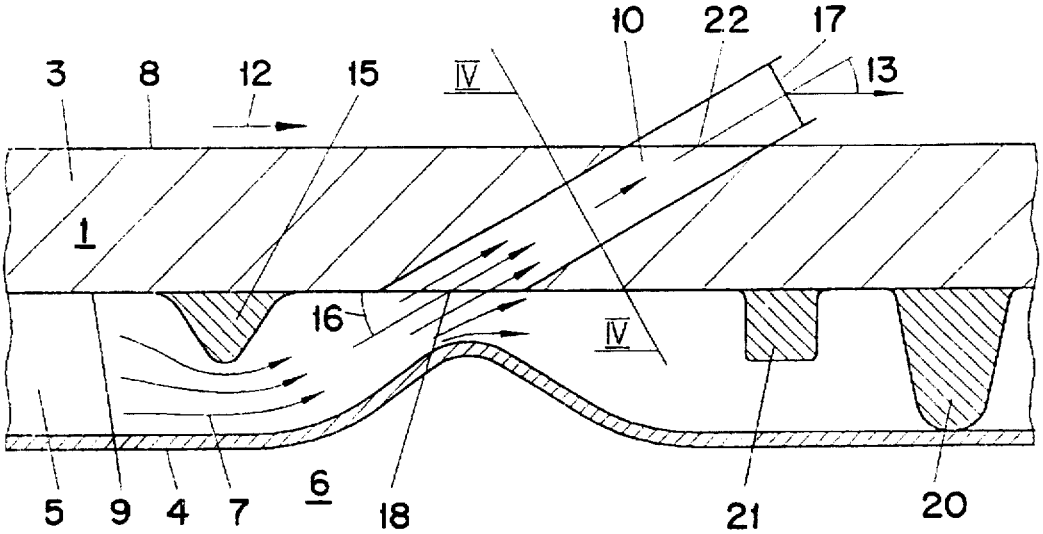
FIG. 3 shows an enlarged detail of the gas-turbine guide blade designed according to the invention, in the region of one of the recesses in the blade wall.

FIG. 3 shows an enlarged detail of a guide blade 1 designed according to the invention. In this guide blade 1, a radial rib 15 of fluidically advantageous design is arranged upstream of each row of cooling bores 10 on the inner surface 9 of the outer shell 3. The cooling insert 4 is shaped in the region of the cooling bores 10 in the direction of the outer shell 3 and in the process is formed at least approximately parallel to the entry angle 16 of the cooling air 7 into the cooling bores 10.

In this case, the rib 15 is arranged at a distance of 3 times the diameter 17 of the cooling bore 10 from the entry center point 18 of the latter. At a distance between the outer shell 3 and the cooling insert 4 which corresponds to twice the diameter 17 of the cooling bore 10, the rib 15 projects by one diameter 17 of the cooling bore 10 into the cooling hollow space 5. In the region of the cooling bore 10, the cooling insert 4 is shaped in the direction of the outer shell 3 in such a way that it closes the cooling hollow space 5 there to 30% of its normal size.

Figure 4:
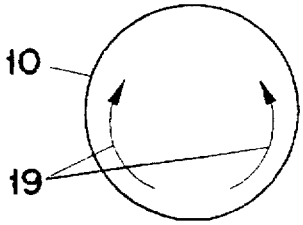
FIG. 4 shows a section IV—IV through the recess in the guide blade according to FIG. 3.

On account of this design, the cooling air 7 is already deflected in the cooling hollow space 5, i.e. in the region upstream of the respective cooling bores 10, in the direction of the bores, whereby recirculation zones in the cooling bore 10 are avoided. In each case a vortex pair 19 oriented in opposition to the kidney vortices 14 thereby develops in the interior of the cooling bores 10. The center of rotation of this so-called inner vortex 19 is not located in the center of the cooling bore 10 but in the lower region of the cooling-air jet (FIG. 4).

In particular, the design of the rib 15 leads to a substantially greater deflection of the cooling air 7 when the latter enters the cooling bores 10. Hitherto, a deflection of about 30° was normal here, whereas the cooling-air 7 is now deflected at an angle of up to 50°. The increased deflection of the cooling air 7 and the prevention of a recirculation zone in the cooling bores 10 result in a clearly more stable inner vortex 19. Thus this inner vortex 19 is retained even during the discharge from each of the cooling bores 10, whereas the undesirable kidney vortex 14 in the upper region of the cooling-air jet is quickly broken down. The inner vortex 19 now provides for the hot gas 12 to be directed in a cooled state to the outer surface 8 of the outer shell 3 of the guide blade 1.

In the cooling hollow space 5, a spacer 20 and a pin 21 are arranged downstream of the cooling bore 10 and approximately centrally between two adjacent cooling bores 10. Both the spacer 20 and the pin 21 are connected to the inner surface 9 of the outer shell 3, the spacer 20 extending to the cooling insert 4 and the pin 21 being of shorter design. Due to the central arrangement of spacer 20 and pin 21 between two adjacent cooling bores 10, sufficient heat transfer from the outer shell 3 to the cooling air 7 is achieved even in this region having the least cooling effect, i.e. up to about five diameters 17 downstream of the discharge center point 22 of the cooling bore.

Such a cooling configuration is of course not restricted to the guide blades 1 of gas turbines. It may likewise be used in moving blades, combustion-chamber walls, heat-accumulation segments of gas turbines or in other walls 3 surrounded on one side by hot gas 12.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. An arrangement for cooling a wall surrounded on one side by hot gas, in particular the hollow-profile body of a gas-turbine blade, comprising a wall having an outer surface and an inner surface, a cooling insert arranged substantially parallel to the wall and forming together with the wall a cooling hollow space, and a row or a plurality of rows, arranged one behind the other in a direction of flow of a cooling fluid, of recesses which extend between the two surfaces of the wall, the recesses each having a predetermined entry and discharge angle and a diameter, wherein upstream of each row of recesses, a radial rib is arranged on the inner surface of the wall, and the cooling insert is shaped in the region of the recesses to extend in the direction of the wall and in the process is formed at least approximately parallel to the entry angle of the recesses.

2. The arrangement as claimed in claim 1, wherein the recesses have an entry center point from which the ribs are arranged at a distance of up to about 3 times the diameter of the recesses into the cooling hollow space, and the shaped portion of the cooling insert narrows the cooling hollow space in the region of the recesses up to a maximum of 30% of the normal distance between the wall and the cooling insert.

3. The arrangement as claimed in claim 1, wherein in each case at least one spacer is arranged in the cooling hollow space downstream of the recesses and is connected to the inner surface of the wall, the at least one spacer extending up to the cooling insert.

4. The arrangement as claimed in claim 3, wherein the spacers are arranged centrally between two rows of adjacent recesses.

5. The arrangement as claimed in claim 1, wherein in each case at least one pin is arranged in the cooling hollow space downstream of the recesses and is connected to the inner surface of the wall, the pins ending a distance from the cooling insert.

6. The arrangement as claimed in claim 5, wherein the pins are arranged centrally between two rows of adjacent recesses.

7. A method of cooling a wall surrounded on one side by hot gas, in particular the hollow-profile body of a gas-turbine blade, comprising the steps of directing a cooling fluid into a cooling hollow space between the wall to be cooled and a cooling inserts allowing the cooling fluid to flow along the wall for cooling, and directing the cooling fluid to be blown out via at least one row of recesses in the wall, wherein the cooling fluid is guided in the hollow space to take an entry direction of the recesses before reaching the recesses.

8. The method as claimed in claim 7, wherein some of the cooling fluid is directed past an upstream row recesses, is accelerated and oriented toward the inner surface of the wall, and then is directed to a downstream row of recesses.

9. The method as claimed in claim 8, wherein the cooling fluid, before reaching the downstream row of recesses, is directed past spacers formed in the cooling hollow space.

10. The method as claimed in claim 6, wherein the cooling fluid, before reaching the downstream row of recesses, is directed past pins formed in the cooling hollow space.

* * * * *